US006003901A

United States Patent [19]

Takemura

[11] Patent Number: 6,003,901

[45] Date of Patent: Dec. 21, 1999

[54] COMBINED PHOTO ALBUM AND PICTURE FRAME AND AN EASEL THEREFOR

[75] Inventor: Shun Takemura, Torrance, Calif.

[73] Assignee: Itoya of America, Ltd., Torrance, Calif.

[21] Appl. No.: 09/135,402

[22] Filed: Aug. 18, 1998

Related U.S. Application Data

[60] Provisional application No. 60/070,111, Dec. 31, 1997.

[51] Int. Cl.[6] ..... A47B 23/00; B42D 3/00

[52] U.S. Cl. ..... 281/33; 281/31; 281/22

[58] Field of Search ..... 281/22, 29, 31, 281/33, 51; 402/70, 73; 248/444.1, 459, 460, 461

[56] References Cited

U.S. PATENT DOCUMENTS

| | | | |
|---|---|---|---|
| 2,649,799 | 8/1953 | Spertus . | |
| 2,737,745 | 3/1956 | Hartmann . | |
| 3,545,111 | 12/1970 | Spiegel et al. . | |
| 4,001,960 | 1/1977 | Holson | 281/31 |
| 4,172,332 | 10/1979 | Holes et al. | 281/31 |
| 4,822,195 | 4/1989 | Lu | 402/53 |
| 4,998,361 | 3/1991 | Gordon | 206/45.31 |
| 5,388,798 | 2/1995 | Glick | 248/459 |
| 5,603,528 | 2/1997 | Chen | 281/33 X |
| 5,605,354 | 2/1997 | Kwon | 281/22 |
| 5,661,918 | 9/1997 | Malcolm et al. | 281/33 X |

*Primary Examiner*—Willmon Fridie, Jr.
*Attorney, Agent, or Firm*—Venable; George H. Spencer; Catherine M. Voorhees

[57] ABSTRACT

A combined photo album and picture frame includes a front cover configured as a frame and adapted to carry a picture; a back cover having a pocket; a plurality of pages, each of which is adapted to hold at least one photograph; and an easel for supporting the combined photo album and picture frame where the pocket of the back cover is adapted to hold the easel.

7 Claims, 3 Drawing Sheets

COMBINED PHOTO ALBUM AND PICTURE FRAME AND AN EASEL THEREFOR

CROSS REFERENCE TO RELATED APPLICATION

This application claims the benefits of Provisional Application No. 60/070,111, filed Dec. 31, 1997.

BACKGROUND OF THE INVENTION

The present invention relates to a combined photo album and picture frame and an easel therefor.

Several types of multi-purpose albums are known. However, these known albums either lay flat (i.e., have no support), or have a support attached to the exterior of the album or a separate, bulky support. For example, U.S. Pat. No. 2,649,799 to Spertus discloses a picture-frame album which may be supported in a vertically inclined position by an easel. However, the easel is affixed to the rear of the picture-frame album by gluing or any other suitable manner. Thus, although this known picture-frame album includes an easel, the easel is merely attached to the exterior of the picture-frame album and accordingly, is exposed to wear and tear.

Another known multi-purpose album which uses a non-attached or non-integral support element to display a framed picture on a flat, horizontal surface is shown in U.S. Pat. No. 4,822,195 to Lu. In this multi-purpose album, a complicated procedure of removing screws and the front and back cover is required in order to form a picture frame. Moreover, since the supporting frame is not a part of the multi-purpose album, the supporting frame is usually separate from the album and thus is easily lost. This is especially true in that the photo album must be dismantled to form the picture frame which uses the separate supporting frame.

An album used as a picture frame and a mirror is shown in U.S. Pat. No. 5,605,354 to Kwon. However, the support employed in Kwon's album is physically attached to the exterior of the frame walls. Thus, this support or cover which pivots about a hinge formed in the album frame is also subject to outside forces and may be broken off rendering the picture frame unusable.

Thus, known combination picture frame and photo albums do not provide a safe, secure place for holding an easel while it is not in use.

SUMMARY OF THE INVENTION

It is, therefore, an object of the present invention to provide a combined photo album and picture frame in which the above problems are overcome in a simple manner.

In order to accomplish the above object the combined photo album and picture frame includes a front cover configured as a frame and adapted to carry a picture; a back cover having a pocket; a plurality of pages, each of which is adapted to hold at least one photograph; and an easel for supporting the combined photo album and picture frame where the pocket of the back cover is adapted to hold the easel.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
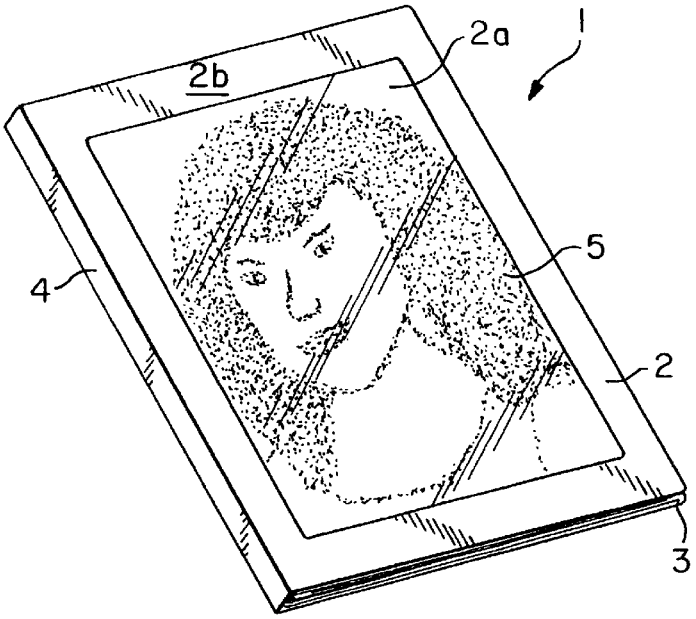
FIG. 1 is a perspective view of the combined photo album and picture frame according to the invention.
Figure 2:
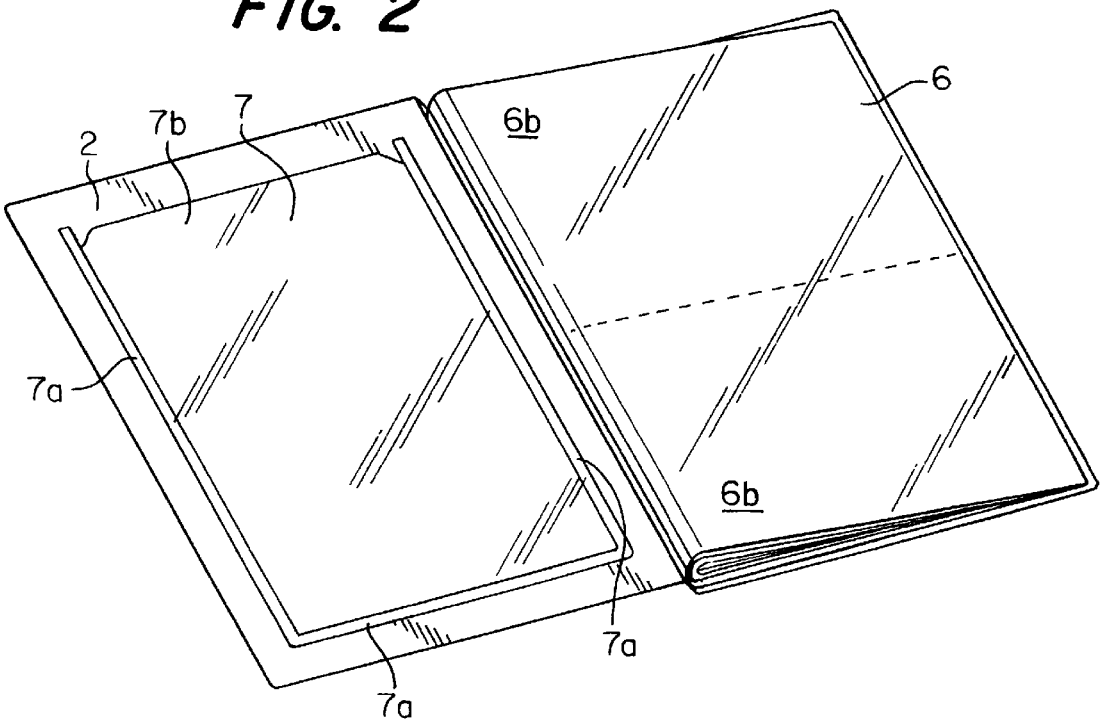
FIG. 2 is a perspective view of the combined photo album and picture frame of FIG. 1 with its front cover open.
Figure 3:
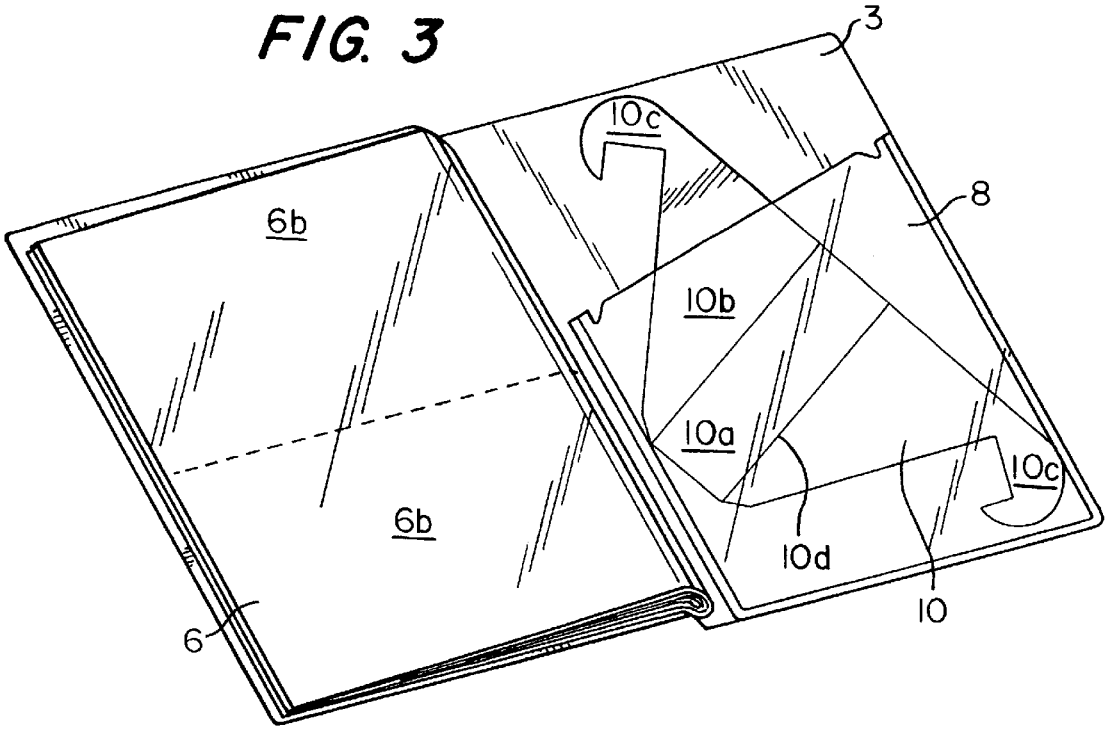
FIG. 3 is a perspective view of the combined photo album and picture frame of FIG. 1 with its back cover open showing the pocket and easel according to the invention.

As shown in FIG. 1 of the accompanying drawings, the invention comprises a photo album 1 having a front cover 2, a back cover 3 and a spline 4 joining the front and back covers. The front cover 2 is configured as a frame and is adapted to carry a picture 5. A plurality of individual pages 6 are inserted between the front and back covers as shown in FIGS. 2 and 3. Each of the individual pages 6 is adapted to hold one or more photographs.

The front side of front cover 2 has a transparent window 2*a* which is surrounded by a border 2*b* that frames window 2*a*. Border 2*b* may be a solid or marbled color. Border 2*b*, back cover 3 and spline 4 may be made from the same sheet of vinyl which preferably is PVC free.

The back or inside of front cover 2 has a rectangular pocket 7 which is secured to the back side of border 2*b*. Pocket 7 is secured on three sides 7*a* as shown in FIG. 2. The fourth side 7*b* is not attached to the inside of front cover 2 and is adapted to receive a photograph, sketch or other artwork which serves as picture 5.

The transparent window 2*a* may be rectangular or oval. Pocket 7 may be a slip-in pocket for receiving artwork or photos up to 8" by 10". Likewise, the plurality of insert pages 6 are transparent and may be slip-in pockets for receiving artwork and photos up to 8" by 10". Thus, a user can store a number of photos or artwork that can also be displayed through front cover 2.

Each one of the plurality of pages 6 may hold more than one photograph. For example, two photos can be stored in each slip-in pocket 6*b*. The size and number of slip-in pockets 6*b* may vary depending on the type of photo album desired. Two 4" by 6" photos may be stored side-by-side in the embodiment shown in FIGS. 2 and 3.

Figure 4:
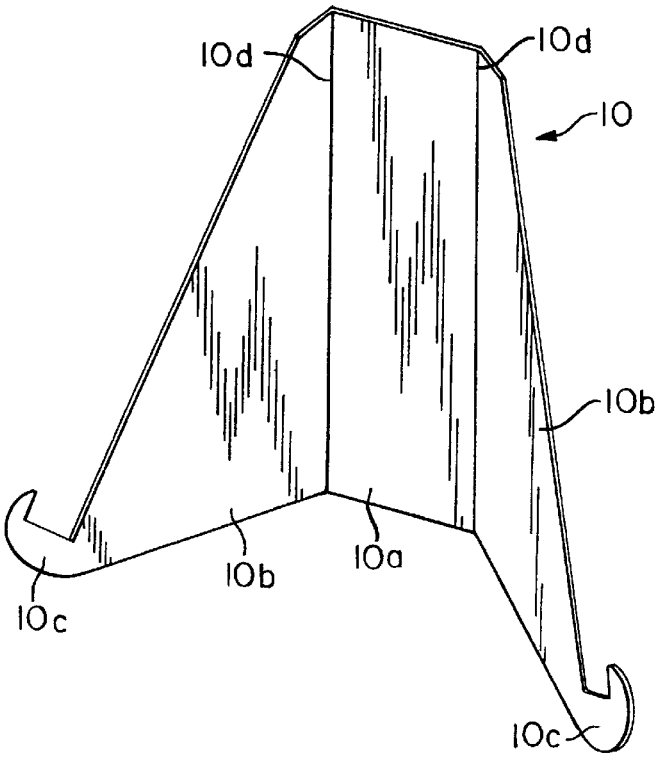
FIG. 4 is a perspective view of an easel according to the invention.

On the inside of back cover 3 of photo album 1, there is a pocket 8 which is capable of holding a flat element 10, depicted in FIG. 3, made of cardboard or plastic or other suitable material. The element 10 has a center portion 10*a* and two adjoining side portions 10*b* having claws 10*c* at their lower extremities. The center and side portions are joined by fold lines 10*d* so that side portions 10*b* together with their claws 10*c* can be bent out of the plane of the flat element. When these side portions 10*b* are bent out by an angle of about 45° they give flat element 10, a configuration as shown in FIG. 4. In this configuration, flat element 10 forms an easel to support photo album 1 and when the easel supports the photo album 1, it has the appearance as shown in FIG. 5.

Figure 5:
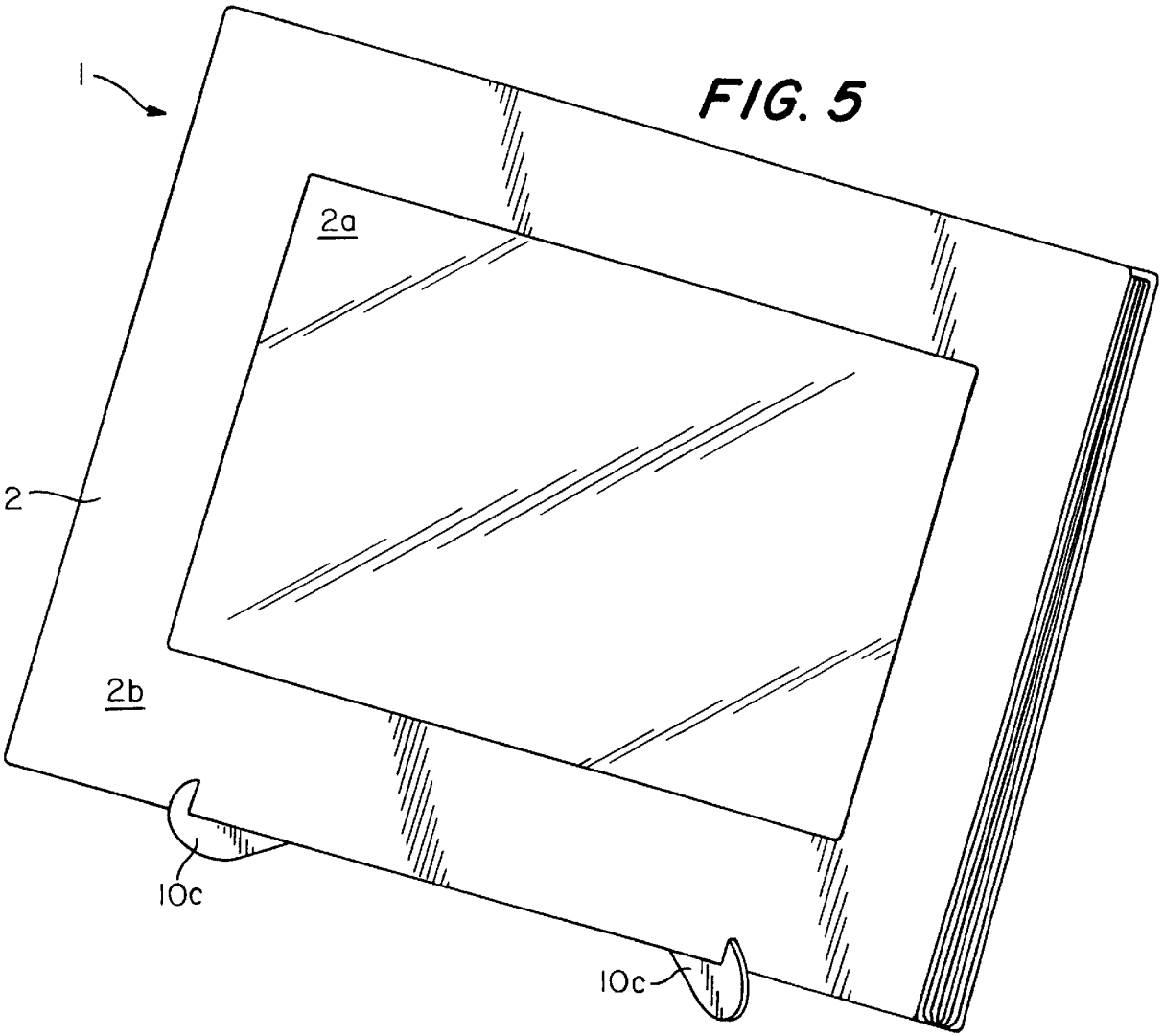
FIG. 5 is a perspective view of the combined photo album and picture frame standing within the easel according to the invention.

Photo album 1 can be supported either horizontally as shown in FIG. 5 or vertically to display picture 5 as shown in FIG. 1.

The photo album can be used by itself to constitute just that, namely, a photo album but when it is supported by the easel, it functions in the manner of a picture frame which is held by the easel, that is, claws 10*c* of element 10 support the photo album at its lower edge. When the photo album is not being used as a framed picture supported by the easel, element 10 can be easily unfolded back into its flat position and then stored in pocket 8 of back cover 3 of photo album 1.

Although the preferred embodiment of the present invention has been disclosed for illustrative purposes, those skilled in the art will appreciate that various modifications, additions and substitutions are possible without departing from the scope and spirit of the invention as disclosed in the accompanying claims.

What is claimed is:

1. A combined photo album and picture frame comprising:

a front cover configured as a frame and adapted to carry a picture;

a back cover having a pocket;

a plurality of pages, each of which is adapted to hold at least one photograph; and an easel for supporting said combined photo album and picture frame, said pocket of said back cover being adapted to hold said easel.

2. A combined photo album and picture frame according to claim 1, wherein said easel can be stored in said pocket of said back cover when not in use.

3. A combined photo album and picture frame according to claim 2, wherein said easel when it is not being used to support said combined photo album and picture frame is flat, and is capable of being bent into a configuration for supporting said combined photo album and picture frame.

4. A combined photo album and picture frame according to claim 3, wherein said easel comprises a flat element with a center portion and two adjoining side portions, each of the adjoining side portions having a claw portion for supporting said combined photo album and picture frame.

5. The combined photo album and picture frame according to claim 4, wherein said pocket is arranged on the inside of said back cover.

6. The combined photo album and picture frame according to claim 3, wherein the combined photo album and picture frame can be supported horizontally.

7. The combined photo album and picture frame according to claim 3, wherein the combined photo album and picture frame can be supported vertically.

* * * * *